US006763845B2

(12) United States Patent
Hoggard

(10) Patent No.: US 6,763,845 B2
(45) Date of Patent: Jul. 20, 2004

(54) WATER FREEZE PREVENTION DEVICE

(76) Inventor: Javier J. Hoggard, 5663 N. Mesa Dr., Castle Rock, CO (US) 80104

( * ) Notice: Subject to any disclaimer, the term of this patent is extended or adjusted under 35 U.S.C. 154(b) by 43 days.

(21) Appl. No.: 10/238,533

(22) Filed: Sep. 9, 2002

(65) Prior Publication Data

US 2004/0045600 A1 Mar. 11, 2004

(51) Int. Cl.[7] ..... F16K 31/64; E03B 7/08; E03B 7/12; F16L 55/07

(52) U.S. Cl. ..... 137/61; 137/78.1; 137/80; 137/624.12; 137/624.18; 137/434; 239/69; 239/70; 239/75; 261/39.1; 261/43; 261/70

(58) Field of Search ..... 137/59, 60, 61, 137/62, 78.1, 78.2, 78.3, 79, 80, 434, 624.186, 624.12; 237/80; 239/69, 75, 70; 261/38, 98, 70, 39.1, 42, 43; 62/310

(56) References Cited

U.S. PATENT DOCUMENTS

| | | | | |
|---|---|---|---|---|
| 3,929,154 A | | 12/1975 | Goodwin | |
| 4,216,554 A | | 8/1980 | Glueckert et al. | |
| 4,243,062 A | | 1/1981 | Shelton | |
| 4,286,613 A | | 9/1981 | Lacoste | |
| 4,730,637 A | * | 3/1988 | White | 137/62 |
| 4,755,112 A | | 7/1988 | Houser et al. | |
| 4,763,682 A | | 8/1988 | Gardner et al. | |
| 4,766,925 A | | 8/1988 | Frantz | |
| 4,921,001 A | * | 5/1990 | Pittsinger | 137/78.2 |
| 5,113,892 A | | 5/1992 | Hull et al. | |
| 5,154,349 A | * | 10/1992 | Vaughn | 239/69 |
| 5,220,937 A | | 6/1993 | Roberts et al. | |
| 5,240,179 A | | 8/1993 | Drinkwater | |
| 5,273,687 A | * | 12/1993 | Osborne | 261/98 |
| 5,464,044 A | * | 11/1995 | Brinkerhoff | 137/78.3 |
| 5,488,968 A | | 2/1996 | Price et al. | |
| 5,694,963 A | * | 12/1997 | Fredell et al. | 137/2 |
| 5,746,240 A | * | 5/1998 | Ayotte et al. | 137/59 |
| 5,826,792 A | * | 10/1998 | Hasslinger | 239/69 |
| 6,125,873 A | * | 10/2000 | Brown | 137/62 |
| 6,367,277 B1 | * | 4/2002 | Kinkel | 62/310 |
| 6,585,168 B1 | * | 7/2003 | Caprio | 137/78.2 |

* cited by examiner

*Primary Examiner*—George L. Walton

(57) ABSTRACT

An automatic water freeze prevention device having a first valve, second valve and third valve that cooperate to fill or drain a water utilization device according to pre-selected temperature conditions. These three valves are driven to their respective open/closed positions by an electrical power sending device that is, in turn, actuated by a temperature setting device that is associated with a temperature sensing device.

27 Claims, 4 Drawing Sheets

26
18
20A
22
24
20B
30'
20
34
40
54
14
70
10
56
60
62A
52
34
69
66A
50
32
46
19B
38
30
12
28
48A
68
66B
66C
48
64A
64B
64C
40
62B
32
60
58
40
16
42

WATER FREEZE PREVENTION DEVICE

BACKGROUND OF THE INVENTION

Weather exposed, water utilizing devices such as evaporative coolers (e.g., "swamp coolers"), lawn sprinklers, agricultural watering systems and so forth are usually winterized through use of water valve shut-off and vacuum bleed-off systems. Such water utilizing devices may be directly or indirectly exposed to freezing conditions. For example, in the case of evaporative coolers, the coolers themselves, as well as the water piping (usually copper water pipes) leading to and from them, may reside in (or pass through) low temperature exposed areas such as unheated attics. Consequently, as fall and winter approach, all such cold temperature exposed water utilizing devices, and their associated water piping systems, must be fully drained before the first freeze of the year.

The procedures used to winterize these devices are normally manual in nature. They usually begin with manually shutting off a water supply valve on a water supply line that leads from a water source line to the water utilizing device. Another valve is then manually opened in order to drain any water contained in the water utilizing device (e.g., a reservoir of water in an evaporative cooler). Any water held in any water supply or drainage pipe (e.g., by the presence of a vacuum) also must be drained. To this end, water drainage and/or vacuum bleed off valves are placed at appropriate places in the water pipe system that service such water utilization devices. For example, vacuum bleed off valves are located at or near a high point in a water pipe system that services the water utilizing device. When such a valve is opened, any vacuum in a water pipe serviced by that valve is broken and thereby allowing gravity to drain the pipe into a low lying drainage line.

Use of these manually operated valves often creates certain inconveniences and/or hazards to humans. For example, because evaporation coolers are usually located on top of the building they serve (e.g., on top of a residence, commercial building, industrial building or farm building), they are often attended through use of high stepladders that create inconveniences and/or hazards. Next, it should be noted that, even though they may not require use of ladders, similar winterizing procedures are used in the context of lawn or agricultural sprinkler systems. Here again, the water supply is first manually shut off. Thereafter, a water drainage valve leading from the sprinkler device is opened. Any water held in any vacuum-containing pipes also must be drained. Manually operated air bleed off valves also may be employed for this purpose. In the alternative, some water utilizing devices and their associated piping system are winterized through use of blasts of air delivered to such systems by on-site, or portable air compressors. In either case, the use of such air compressors involves added labor and air compressor equipment costs. Thus there is a need for water freeze prevention devices that operate automatically, and especially those that operate automatically without any need for air compressor equipment.

SUMMARY OF THE INVENTION

Applicant has invented an automatic water drainage/refill apparatus for use in conjunction with various kinds of cold weather exposed, water utilizing devices. For purposes of illustration only, applicant will use an evaporative cooler and a lawn sprinkler system as specific examples of such water utilizing devices. The automatic drainage/refill apparatus of this patent disclosure also may be hereinafter referred to as "water freeze prevention device(s)". Nomenclature aside, applicant's water freeze prevention devices employ (1) at least three automatically operated valves that open or close as part of at least two distinct modes of operation, a draining mode and a filling mode, (2) a temperature setting device for selecting one or more temperatures whose attainment will invoke each of the least two modes of operation, (3) a temperature sensing device capable of detecting one or more temperatures that is (are) capable of invoking the at least two modes of operation, (4) an electrical power sending device such as a transformer that powers the automatically operated valves and (5) electrical circuitry for placing applicant's device in its two different modes of operation. Optionally, applicant's water freeze prevention devices may further comprise (6) a mounting board to which the above-noted components are physically mounted to create a unified water freeze prevention device that is especially well suited for attachment to water piping leading to and from an existing water utilization device, (7) water pipes leading to and from the valves, (8) water pipe connector devices (couples, threaded ends and the like) and (9) electrical connecting devices (e.g., an electrical plug) for connecting at least one component of the water freeze preventing device to a source of electrical power.

Preferably, the first valve further comprises an electrically driven valve actuator capable of moving said first valve back and forth between an open position and a closed position in order to fill or drain the water utilization device. Likewise, the second valve has its own separate and distinct electrically powered valve actuator for opening and closing said second valve in order to drain (or block drainage of) water from that portion of a first pipe located between the first valve and the water utilization device. Likewise, the third valve is provided with its own independently operable, electrically driven valve actuator that is capable of moving said third valve back and forth between an open position and a closed position in order to drain (or block drainage of) the water utilization device. These three valves can be operated simultaneously, or sequentially.

The at least two modes of operation of applicant's water freeze prevention device are respectively invoked by detection of one or more pre-selected temperatures. These pre-selected temperatures are preferably entered into a temperature setting device (such as a thermostat) by a human. In any case, detection of this (these) temperature(s) create(s) certain hereinafter described electrical signals and currents that ultimately operate the three valves according to which mode of operation is then being carried out (i.e., draining or filling the water utilizing device). The pre-selected temperature(s) is (are) transduced into electrical signals that operate the valves. In effect, these temperature generated signals are intended to anticipate certain sustained, seasonally expected, temperature conditions. However, in the event that the sustained, seasonally expected, temperature conditions prove to be "unsustained", the hereindisclosed device can readily cycle back and forth between the two modes of operation until the expected weather conditions become sustained.

In one particularly preferred embodiment of this invention, the temperature sensing device will be set (manually, electrically or mechanically) to detect a single temperature. Normally, such a single temperature (e.g., 40° F.) will be between about 35° F. and 55° F. The temperature sensing device is preferably constructed and/or programmed such that it will go into its water utilizing device filling mode at a temperature slightly above the single temperature (e.g., one to three ° F. above the single set temperature). For example, if the temperature tolerance is 1° F., and the set temperature is 40° F., then attainment of 41° F. will cause the water utilization device to be filled. Conversely, when the ambient temperature reaches the set temperature (or a lower temperature), the water freeze prevention device will go into its draining mode. Thus, in the above example, when a falling ambient temperature reaches the pre-selected 40° F. temperature (or a lower temperature), the water utilization device will be drained.

In another preferred embodiment of this invention, the temperature setting device will act upon two separate and distinct temperature settings that are respectively associated a water utilizing device filling mode and a water utilizing device draining mode. In certain particularly preferred embodiment of this invention these two temperatures will be set above 32° F. and at least 5 degrees Fahrenheit different from each other. For example, in its first mode of operation, applicant's water freeze prevention device can be set to detect a first, relatively lower, non-freezing, pre-selected temperature (e.g. 45° F.) that serves to anticipate the advent of those fall or winter temperatures that are capable of freezing water (i.e., 32° F. or less). When this first pre-selected temperature is encountered, a subject water utilization device, and any water pipes associated with it, will be automatically drained by the hereindescribed water freeze prevention device.

In its second mode of operation, a second, relatively higher, non-freezing, pre-selected temperature (e.g., 65° F.) can be set to detect the advent of those sustained weather conditions (e.g., springtime temperatures) that are not capable of freezing water (e.g., sustained temperatures above 32° F.). When this second pre-selected temperature (e.g., 65° F.) is encountered, the water utilization device will be filled with water so that it can carry out its intended function (e.g., evaporative cooling, lawn sprinkling, agricultural spraying, etc.). In the event, however, that applicant's water freeze prevention device again encounters the pre-selected lower temperature (e.g., 45° F.), the water utilization device will be automatically drained. Consequently, using either a one pre-set temperature method of operation, or a two pre-set temperature method of operation, applicant's water freeze prevention device can adapt to changing temperature conditions—and especially to those changing weather conditions that take place during spring or fall where freeze conditions may occur intermittently. For example, freezing conditions may occur at night, but the temperature may rise far enough the next day to require use of an evaporative cooler, sprinkler, etc.

Be such temperature changes as they may, in its first mode of operation (invoked by detection of either a single set temperature, e.g., the 40° F. single temperature setting previously noted or by detection of a relatively lower temperature, e.g., 45° F. of a two temperature e.g., 45° F. and 65° F. detection method of operation), a first valve (that controls water flow through a water feed line that leads from a water supply source to the water utilization device) is automatically shut off and thereby preventing water flow to that water utilizing device. In this first mode of operation, applicant's second valve is automatically opened to drain water from that portion of the water feed line that is generally located between the first valve and the water utilizing device. Similarly, applicant's third valve is automatically opened in order to drain the water utilization device itself. Thus a subject water utilizing device (e.g., an evaporative cooler and its associated piping system) and certain freezing temperature exposed-portions of applicant's device are drained and thus "winterized". In a particularly preferred embodiment of this invention, one or more bottom drain for applicant's device collects and disposes of drainage from those water pipes leading from the second and third valves.

The three valves of the hereindescribed water freeze prevention device, as well as the drain(s) may all reside in a "warm" location i.e., a location that is not susceptible to water freezing temperature conditions. Placement of certain components of applicant's freeze prevention device in such a warm location will especially serve to prevent freezing of any water in the pipe located between the water source (e.g., a water supply line or water pump) and the first valve. Placement of all of the valves in a warm location is not, however, a mandatory requirement. Indeed, in some particularly preferred embodiments of this invention, the third valve may be attached to a water utilization device that is located out of doors and therefore exposed to freezing temperatures.

In the single temperature sensing embodiment of this invention, the second mode of operation of applicant's water freeze prevention device can be invoked by sensing a single temperature e.g., 40° F. (or a temperature that is within a tolerance of the single temperature such as a ±3° F. tolerance). In the two temperature sensing embodiment of this invention, a second, relatively higher, pre-selected temperature (e.g., 65° F.) is also detected. This second temperature also can be provided with a temperature tolerance such as ±3° F. Again, a sensing of the single temperature or the relatively higher second temperature is intended to anticipate the advent of spring and its sustained nonfreezing weather conditions. In either case, in the second mode of operation of this water freeze prevention device, the previously closed first valve, located on a water feed source, is opened. This allows the water utilizing device to be filled with water in order to carry out its intended function. Detection of the single pre-selected temperature, or the second, relatively higher, pre-selected temperature (e.g., 65° F.) also causes the second and third valves to close. Closure of the second valve prevents water from being drained from that portion of the water supply line generally located between the first valve and the water utilizing device. Closure of the third valve prevents drainage of the water utilization device. In some particularly preferred embodiments of this invention, the water utilizing device (and especially an evaporative cooler) is provided with its own shutoff valve. Such a shut off valve serves to stop water flow through the water feed line to the water utilization device when the incoming water reaches a prescribed level in a water reservoir of the water utilization device. In certain particularly preferred embodiments of this invention, this shut off valve is a so-called "float valve" that is physically operated by the rise and fall of a water level in the water reservoir of the water utilization device.

Applicant's water freeze prevention device also employs a temperature setting device (e.g., a thermostat) for selecting (1) a single pre-set temperature (e.g., 40° F.) that (exactly, or within certain temperature tolerances) causes the water utilization device to be filled or drained, or (2) at least one relatively lower temperature (e.g., 45° F.) that invokes the first mode of operation (draining) and (3) at least one relatively higher temperature (e.g., 65° F.) that invokes the second mode of operation (filling). Most preferably, the temperature setting device has a range of temperatures from about 32° F. to about 80° F. from which the desired temperatures to be employed by this water freeze prevention device (e.g., 40° F., 45° F. and 65° F.) can be individually selected. Preferably, each of these temperatures can be "stored" somewhere in applicant's freeze prevention device, e.g., in the temperature setting device (e.g., in a thermostat) by known electrical/mechanical devices (e.g., in a computer chip, electrical signal storage device or mechanical keying device) once the desired temperature(s) is (are) selected by the operator.

Applicant's water freeze prevention device also employs an electrical power sending device to operate the electrically powered components of said device (e.g., its electrically operated water valves, the thermostat, a computer chip memory device containing, etc.). This electrical power sending device is preferably a transformer. Such an electrical power sending device send direct current (DC) or alternating current (AC) to the valves, thermostat, computer device, etc. according to their respective distinct modes of electrical operation. For example, if the electrical source used to operate applicant's water freeze prevention device is a DC generating battery, the power sending device will send an appropriate direct current to the valves (and to the thermostat). More preferably, however, a commonly available AC "house current" will be used to power applicant's water freeze prevention devices. That is to say that, in the more preferred embodiments of this invention, the source of power used by applicant's devices will be a commonly available 120 volt, 60 cycle, alternating electrical current (AC). Preferably, such a house current is "stepped down" by an electrical transformer type, power sending device. Such a transformer device also will preferably convert an AC house current to a DC current suitable for operation of certain direct current employing valves (e.g. suitable for operating commercially available zone valves that employ 15–20 volt, DC currents).

Yet another component of applicant's water freeze prevention device is a temperature sensor (e.g., a thermocouple, a thermometer, etc.) that is capable of detecting the previously described single temperature (e.g., 40° F.) and/or the previously described first, relatively lower, pre-selected temperature (e.g., 45° F.) and the second, relatively higher, pre-selected temperature (e.g., 65° F.). In a particularly preferred embodiment of this invention, the detected temperatures are transduced into electrical signals that are sent to a temperature setting device such as a thermostat which, in turn, sends an electrical signal to an electrical current sending device such as a transformer. Based upon such an electrical signal from the temperature setting device, the electrical current sending device then sends the electrical power needed to operate each of the three valves. In a particularly preferred embodiment of this invention, such an electrical current sending device (e.g., transformer) also provides electrical power to an electrically powered thermostat.

In yet another preferred embodiment of this invention, the temperature sensing device of this patent disclosure is a component of a thermostat unit. Again, such a temperature sensing device should be capable of detecting, and then acting upon, a single temperature (e.g., 40° F.) employed in a single temperature mode of operation and/or at least two separate and distinct temperature settings employed in multiple temperature (e.g., previously noted 45° F. and 65° F.) mode of operation. Preferably, each of these temperatures can be variably selected (e.g., a lower temperature selected between 35° F.–55° F. and a higher temperature selected between 56° F. and 70° F.). Again, a temperature at or below a single temperature (e.g., 40° F.), or a relatively lower threshold temperature setting (e.g., 45° F.) of a two temperature based method of operation, is associated with a winterizing, first mode of operation that drains the water utilizing device. A temperature (e.g., 41° F.) somewhat higher than the single temperature (40° F.), or a relatively higher threshold temperature setting (e.g., 65° F.) of the two temperature method of operation is associated with placing the water utilization device in service by filling it with water. It also should be appreciated that one result of having a two temperature method of operation of the hereindescribed water freeze prevention devices is the creation of a neutral temperature range that keeps a water freeze prevention device in a dormant state until one of the two pre-selected threshold temperatures is met. This neutral range can be varied according to locally expected weather conditions and patterns.

In yet another highly preferred embodiment of this invention a "failsafe" mode of operation is also provided for reasons of automatic damage control and/or safety. For example, in the event of an electrical power failure or other malfunction, certain electrical detection and signal devices that are capable of automatically going into operation, in order to place the water freeze prevention device in its drained or winterized condition. That is to say that in order to attain this failsafe condition, the device will be automatically placed in its drain mode of operation.

DETAILED DESCRIPTION OF THE INVENTION

Figure 1:
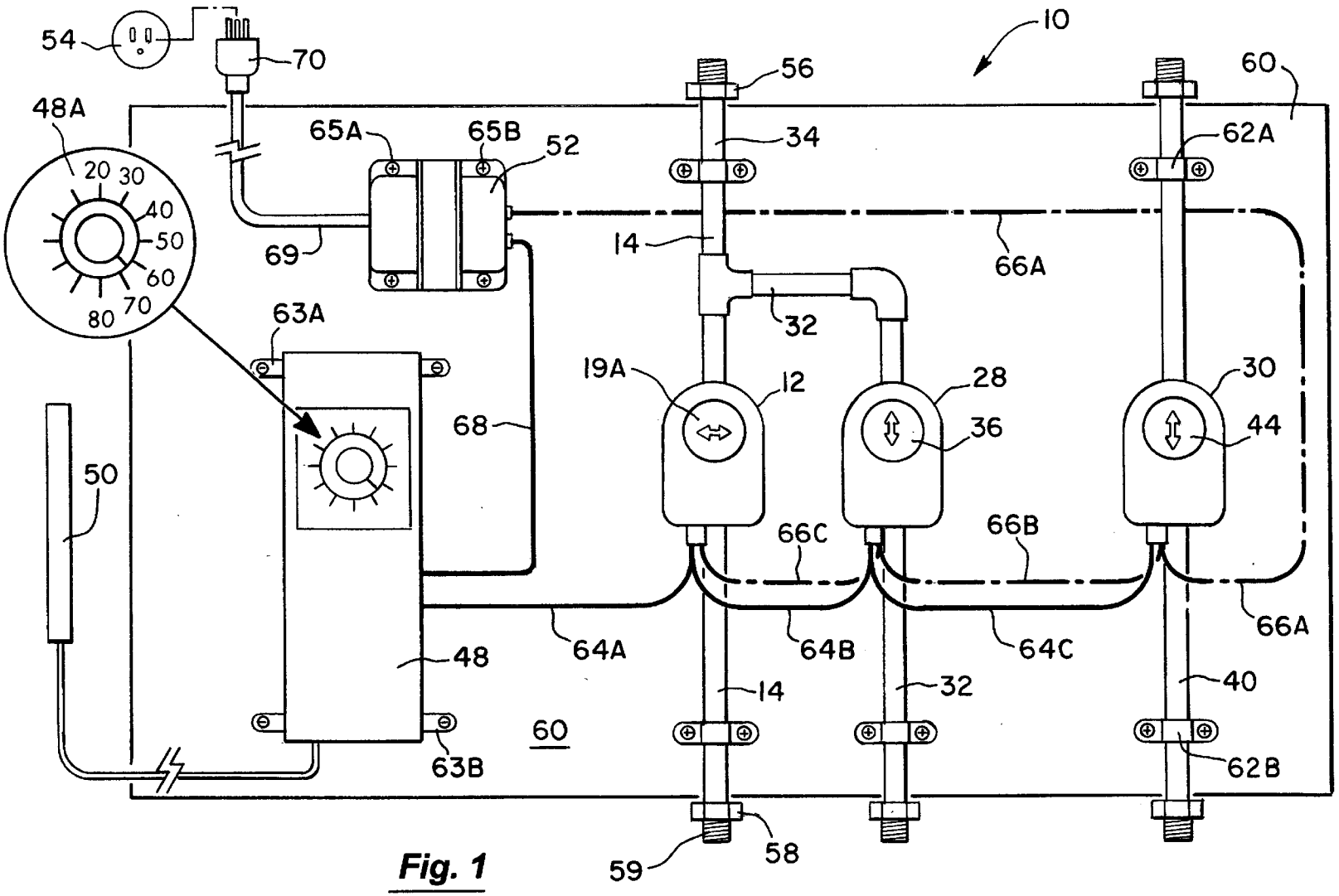
FIG. 1 is a schematic of a water freeze prevention device made according to the teachings of this patent disclosure. It is depicted in its first mode of operation.

FIG. 1 depicts a water freeze prevention device 10 made according to the teachings of this patent disclosure. This device is shown having six main components. The first main component is a first valve 12 for regulating flow of water through a first pipe 14 leading from a water inlet device 16 (see FIG. 2) to a water utilizing device 18 (again, see FIG. 2). This first valve 12 is depicted in FIG. 1 as being in a closed position 19A that blocks flow of water from the water inlet device 16 to the water utilization device 18. This closed position 19A is associated with the device's first mode of operation (i.e., the mode used to drain the water utilizing device 18). In this first mode of operation, a hereinafter described second valve 28 and a hereinafter described third valve 30 are in their respective open positions 36 and 44.

The first valve 12 also has an open operating position 19B (see FIG. 2) that permits flow of water from the water inlet device 16 to the water utilization device 18. This open position 19B is associated with the device's second mode of operation (filling the water utilizing device 18). Water flow into this water utilization device 18 also is preferably separately controlled by a water level control valve 20 (see FIG. 2) in the water utilization device 18. For example, a flotation valve 20A such as that shown in FIG. 2 can be used to shut off water flow into this evaporative cooler type of water utilization device 18 when the incoming water reaches a predetermined level 22 in a water reservoir in the water utilization device 18 (e.g., the water reservoir 24 in the evaporative cooler 26 shown in FIGS. 2 and 3).

The second main component of the water freeze prevention device 10 depicted in FIG. 1 is a second valve 28 for regulating water flow through a second pipe 32 leading from a portion 34 of the first pipe 14 that is generally located between the first valve 12 and the water utilizing device 18. The second valve 28 shown in FIG. 1 is in an open operating position 36 (see also FIG. 3) that serves to drain water from that portion 34 of the first pipe 14 located between the water utilizing device 18 and the first valve 12 when said second valve 28 is in its open operating position 36. The second valve 28 also has a closed position 38 (see FIG. 2). This closed position 38 prevents draining of the portion 34 of pipe 14 located between the first valve 12 and the water utilization device 18.

Figure 2:
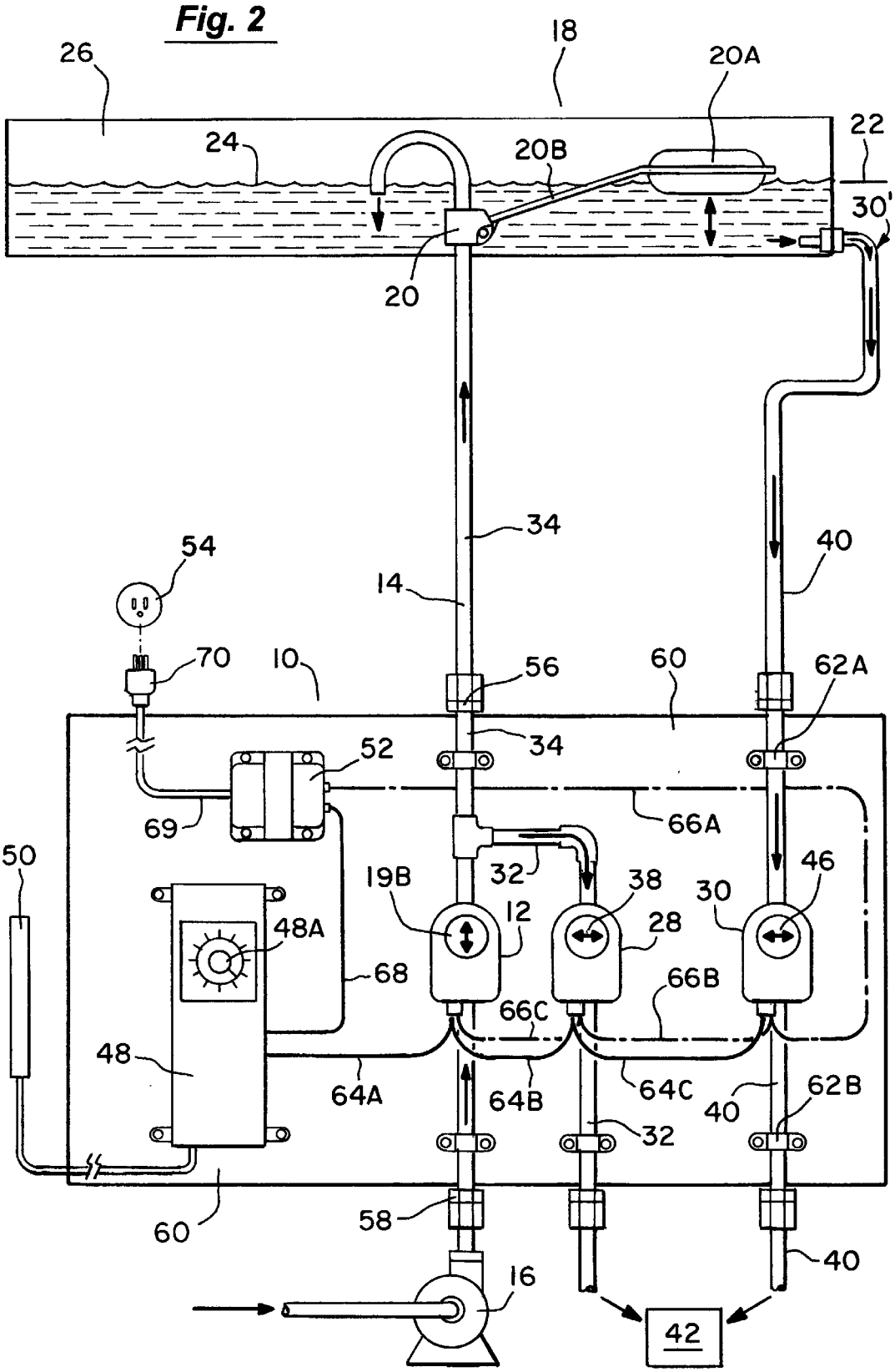
FIG. 2 depicts the water freeze prevention device of FIG. 1 being used in conjunction with an evaporative cooler. The evaporative cooler is shown in its second mode of operation wherein its reservoir is filled with water.

The third main component of applicant's water freeze prevention device 10 is a third valve 30 for regulating flow of water through a third pipe 40 leading from the water utilizing device 18 to a water disposal system 42 (see FIG. 2). FIG. 1 depicts this third valve 30 in its open operating position 44 that serves to drain water from the water utilizing device 18, especially when applicant's device 10 is in its first, or water draining mode. Thus, in this first or draining mode, the third valve 30 is in its open position 44 when the second valve is in its open position 36 and when the first valve 12 is in its closed operating position 19A. Conversely, when the third valve 30 is in its closed position 46 (when applicant's device 10 is in its second mode of operation), it prevents water from draining from the water utilization device 18. The first, second and third valves can be operated serially or in unison. In a particularly preferred embodiment of this invention, the first valve 12 is being opened as the second valve 28 and the third valve 30 are being closed in order to fill the water utilization device 18. In another particularly preferred embodiment of this invention the first valve 12 is being closed as the second and third valves are respectively being opened in order to (1) drain the portion 34 of the water supply line 14 located between the first valve 12 and the water utilization device 18 into the drain 42 and (2) drain the water in the water utilization device 18 into drain 42.

The fourth main component of applicant's water freeze prevention device 10 is a temperature setting device 48 such as a thermostat that can invoke the first mode of operation and the second mode of operation. This temperature setting device enables the user to pre-select (1) a single pre-selected temperature (e.g., 40° F.) at or near which the water utilization device is drained or filled or (2) a first temperature (e.g., 45° F.) at which the water freeze prevention device 18 will be activated into its first mode of operation in order to drain said water utilizing device 18. Preferably, use of this same temperature setting device also enables the user to pre-select a second temperature (e.g., 65° F.) that refills the water utilization device 18. This refilling is brought about by placing applicant's device 10 in its second mode of operation (see FIG. 2). In this second mode of operation, the first valve 12 is placed in its open position 19B while the second valve 28 and third valve 30 are placed in their respective closed positions 38 and 46.

The fifth main component of applicant's invention depicted in FIG. 1 is a temperature sensing device 50 such as a thermocouple, thermometer or the like. This temperature sensing device 50 preferably senses a single temperature (e.g., 40° F.), and/or both a first, relatively lower temperature (e.g., 45° F.) associated with the device's first mode of operation and a second, relatively higher temperature (65° F.) associated with the device's second mode of operation. These sensed temperatures are preferably transduced by the thermostat into electrical signals that, via the power sending device, invoke appropriate operation of the valve actuators. That is to say that detection of any of these pre-selected temperatures causes the thermostat to send an electrical signal to applicant's electrical power sending device that, in turn, sends an electrical current to each of the three valves. Again, by way of example only, detection of the single temperature of the single temperature method of operation, or detection of a first temperature (e.g., 45° F.) of a two temperature mode of operation will cause the water freeze prevention device 10 to go into a first mode of operation, wherein (1) the first valve 12 is moved to its closed position 19A, (2) the second valve 28 is moved to its open position 36, and (3) the third valve 30 is moved to its open position 44. Thus, in this first mode of operation, the water utilization device is shut off from its water supply source 16 and then drained to prevent water freeze damage to either the water utilization device 18, the water pipes or the freeze prevention device 10 itself.

In its second mode of operation, the water utilization device 10 of FIG. 1 is filled with water delivered from the water supply source 16 via the first pipe 14 and the first valve 12 (in its open position 19B) while the second and third valves are in their respective closed positions 38 and 46. Upon reaching a certain prescribed level 22 in a reservoir 24 in the water utilization device 18, the incoming water inflow is stopped by a water level control value 20. This water stoppage is preferably accomplished through use of a float valve 20A operated by attainment of a given water level 22 in the reservoir 24.

The sixth main component of applicant's device shown in FIG. 1 is a an electrical power sending device 52 that supplies electrical power, at a suitable voltage, to the valves and, preferably, to the temperature setting device (thermostat) as well. As previously noted, one highly preferred embodiment of this invention calls for this electrical power sending device 52 to be a transformer capable of converting commonly available 60 cycle, 120 volt, current to certain direct currents (e.g., 15–20 volt DC currents) that are suited to operating many commercially available water valves (so-called, zone valves).

FIG. 1 also depicts the ends of the various water lines 14, 32 and 40 provided with water pipe coupling devices such as pipe union devices 56 and 58, threaded ends 59 and the like. Some or all of the main components can be attached to a mounting device such as a mounting board 60 by means of various mounting devices (e.g., pipe holders 62A, 62B, mounting tabs 63A, 63B, bolts 65A, 65B, etc.) so that applicant's device 10 has a unified character suitable for sale as a pre-assembled kit that is especially well suited to servicing either newly installed, or pre-existing water utilization devices. In some particularly preferred embodiments of this invention, however, the third valve will not be permanently mounted on such a board 60, but rather will be mounted on or near the water utilization device. By way of an example of another preferred embodiment of this invention, FIG. 1 also depicts a transformer 52 provided with an electrical plug 70 suitable for plugging into an electrical power source plug 54.

In certain other particularly preferred embodiments of this invention, the valves are operated in unison. Such unified operation of the three valves can be carried out by an electrical circuitry system such as that depicted in FIG. 1. In this system, a first electrical wire 64A leads from the thermostat 48 to an electrical connector of a given polarity on the first valve 12. A second wire 64B leads from the electrical connector on valve 12 to a counterpart electrical connector on valve 28. Similarly, a third wire 64C leads from the electrical connector on valve 28 to a counterpart electrical connector on valve 30. Thus the three respective given poles of the first valve 12, the second valve 28 and the third valve 30 are electrically connected in series.

A second wire 66A connects the electrical power sending device 52 (e.g., a transformer) to a second electrical pole on valve 30. This second electrical pole on valve 30 is connected (by wire 66B) to a second counterpart electrical connector on valve 28. Similarly, the second counterpart electrical connector on valve 28 is connected (by wire 66C) to a comparable electrical connector on valve 12. The thermostat 48 is connected to the electrical power sending device 52 (e.g., a transformer) via line 68. In turn, the electrical power sending device 52 is connected via line 69 to a plug 70 suited for electrical connection to an outlet plug 54 of an electrical power line (not shown).

FIG. 2 depicts applicant's water freeze prevention device 10 associated with a water utilization device 18 in the form of an evaporative cooler 26. This evaporation cooler 26 has a reservoir of water 24 that has been filled to a given level 22. This given level 22 is controlled by a float valve 20A. When the incoming water reaches this level 22, additional water is prevented from passing through a shut off valve 20 by virtue of the fact that the float valve 20A (which is attached to a lever arm 20B) has reached a prescribed level 22 that mechanically closes the shut off valve 20 and thereby blocking further water flow from pipe 34. In the second mode of operation (depicted in FIG. 2), water is prevented from leaving the water utilization device 18 via drain line 40 by virtue of the fact that the third valve 30 is in its closed position 46. FIG. 2 shows such a closed third valve 30 associated with a mounting board 60. This third valve 30 could, however, be located elsewhere. For example, it could be located on, or near, the water utilization device 18, for example in the location designated 30' in FIG. 2.

Figure 3:
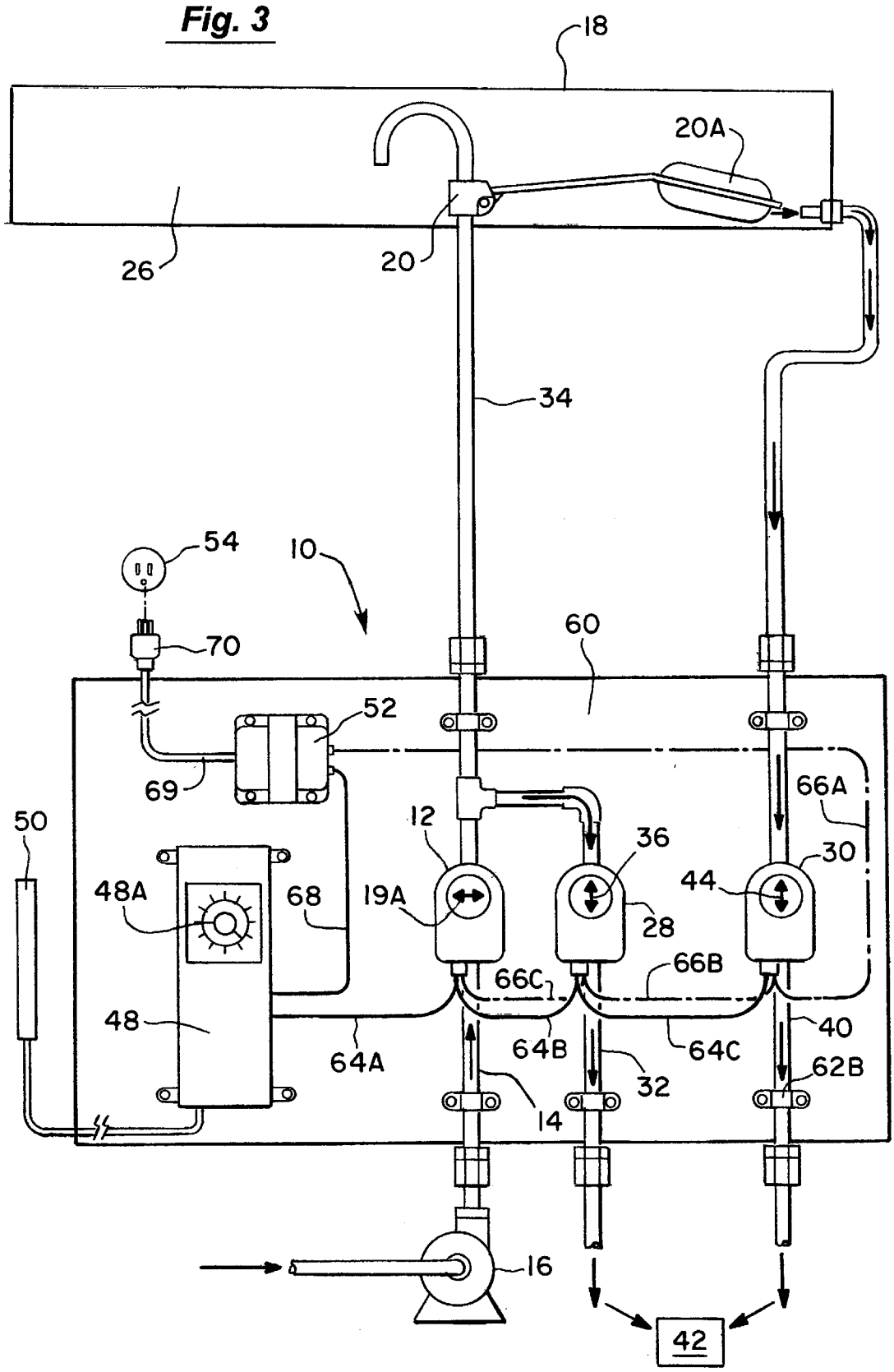
FIG. 3 depicts the water freeze prevention device of FIG. 1 being used in a first mode of operation whereby a reservoir of an evaporative cooler device is placed in its drained condition.

FIG. 3 shows applicant's freeze prevention device 10 being used in conjunction with an evaporative cooler 26 such as shown in FIG. 2. FIG. 3 shows the freeze prevention device 10 in its second mode of operation. Thus, valve 12 is in its closed position 19A, valve 28 is in its open position 36 and valve 30 is in its open position 44. Consequently (1) no water can pass through valve 12 to fill the water utilization device 18, (2) water is drained from pipe 34 via valve 28 (in its open position 36) and sent to drain 42 and (3) water is drained from the evaporative cooler 26 by virtue of the fact that valve 30 is in its open position 44 and thereby allowing water to flow through pipe 40 to a drain 42.

Figures 4A, 4B:
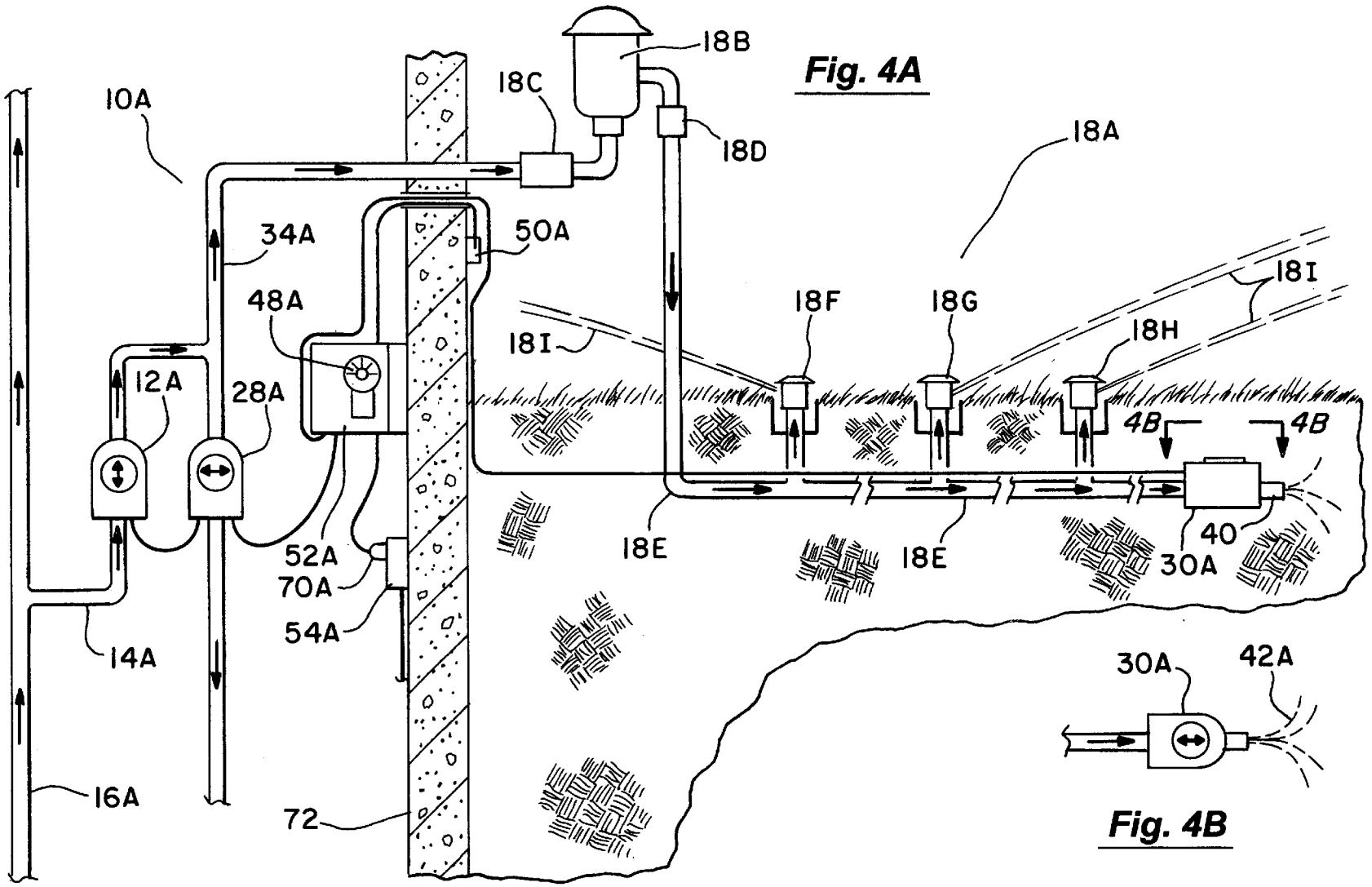
FIG. 4A depicts a water freeze prevention device made according to the teachings of this patent disclosure being used in conjunction with a lawn sprinkling system.
FIG. 4B is a plan view of a third valve shown in FIG. 4A.

FIG. 4A depicts applicant's water freeze prevention device 10A associated with a water utilization device in the form of a lawn sprinkling system 18A shown in its water sprinkling mode. The elements of this water freeze prevention device 10A that have counterpart elements in FIGS. 1, 2 and 3 have been given the same numbers, but with a letter A added to the counterpart element designation. Be that it may, the lawn sprinkling system 18A is shown provided with a vacuum breaker 18B having an inlet valve 18C and an outlet valve 18D. A water supply pipe 18E is shown providing pressurized water to the lawn sprinkler heads 18F, 18G and 18H that spray water 18I on a lawn, garden, crop or the like. FIG. 4A also shows valves 12A and 12B located in a "warm" location inside of a building wall 72 along with various other components of the water freeze prevention device 10. Valve 30A however, is shown located outside of the wall 72 at the end of pipe 18E. It is therefore exposed to water freezing conditions. FIG. 4B is a cross section view that shows how, when valve 30A is opened, water 42A from the vacuum breaker 18B, sprinkler heads 18F through 18H and pipe 18E will be drained as part of this sprinkler's first mode of operation.

Although specific embodiments of this invention have been disclosed herein in detail, it is to be understood that this was for purposes of illustration only. Consequently, this patent disclosure is not to be construed as limiting the scope of the invention since the hereindescribed water freeze prevention devices may be changed in several details by those skilled in the art in order to adapt said devices to particular applications without departing from the scope of the following claims and equivalents of the claimed elements.

Thus having disclosed this invention, what is claimed is:

1. A water freeze prevention device for a water utilizing device that is periodically exposed to water freezing temperatures, said water freeze prevention device comprising: a first valve for regulating water flow through a first pipe leading from a water inlet device to a water utilization device, an electrically driven valve actuator capable of moving said first valve back and forth between a closed position associated with a first mode of operation of the water freeze prevention device and an open position associated with a second mode of operation of said water freeze prevention device, a second valve for draining water from a portion of the first pipe located between the first valve and the water utilization device, an electrically driven valve actuator capable of moving said second valve back and forth between an open position associated with a first mode of operation of the water freeze prevention device and a closed position associated with a second mode of operation of said water freeze prevention device, a third valve for draining water from the water utilization device, an electrically driven valve actuator capable of moving said third valve back and forth between an open position associated with a first mode of operation of the water freeze prevention device and a closed position associated with a second mode of operation of said water freeze prevention device, temperature setting device for invoking the first mode of operation and the second mode of operation of said first, second, and third valves, a temperature sensing device capable of detecting a preset, adjustable temperature that invokes appropriate operation of said valve actuators, and an electrical current sending device capable of driving said valve actuators based upon electrical signals transduced from said preset, adjustable temperature, whereby said water utilizing device is either completely winterized or completely charged with water, such that without electrical power the first valve will be in the closed position to prevent water from entering said water utilizing device and the second and third valves will be in the open position to allow water to drain from said water utilizing device to provide freeze protection in the case of a electrical power outage during freezing conditions.

2. The water freeze prevention device of claim 1 wherein the temperature setting device employs a single temperature.

3. The water freeze prevention device of claim 1 wherein the temperature-setting device employs two different temperatures.

4. The water freeze prevention device of claim 1 wherein the temperature setting device employs a single temperature and a tolerance from that single temperature of less than about three degrees Fahrenheit.

5. The water freeze prevention device of claim 1 wherein the temperature setting device employs two temperatures that are above 32° F. and are at least 5° from each other.

6. The water freeze prevention device of claim 1 wherein the water utilizing device is an evaporative cooler.

7. The water freeze prevention device of claim 1 wherein the water utilization device is a lawn sprinkler device.

8. The water freeze prevention device of claim 1 wherein the water utilizing device is an agricultural spraying device.

9. The water freeze prevention device of claim 1 wherein the water freeze prevention device further comprises a mounting device.

10. The water freeze prevention device of claim 1 wherein the electrical current sending device is a transformer powered by a 120 volt, 60 cycle electrical power source.

11. The water freeze prevention device of claim 1 wherein the electrical current sending device is a transformer that steps down a 120 volt, 60 cycle current and converts it into a DC current suitable for operating the valves.

12. The water freeze prevention device of claim 1 wherein the ends of the first, second and third pipes are provided with pipe coupling devices.

13. The water freeze prevention device of claim 2 wherein the first, second and third valves can be operated in unison.

14. A water freeze prevention device for an evaporative cooler that is periodically exposed to water freezing temperatures, said water freeze prevention device comprising: a first valve for regulating water flow through a first pipe leading from a water inlet device to the evaporative cooler, an electrically driven valve actuator capable of moving said first valve back and forth between a closed position associated with a first mode of operation of the water freeze prevention device and an open position associated with a second mode of operation of said device, a second valve for draining water from a portion of the first pipe located between the first valve and the evaporative cooler, an electrically drive valve actuator capable of moving said second valve back and forth between an open position associated with a first mode of operation of the water freeze prevention device and a closed position associated with a second mode of operation of said device, a third valve for draining water from the evaporative cooler, an electrically driven valve actuator capable of moving said third valve back and forth between an open position associated with a first mode of operation of the water freeze prevention device and a closed position associated with a second mode of operation of said device, a temperature setting device for invoking the first mode of operation and the second mode of operation of said first, second, and third valves, a temperature sensing device capable of detecting a preset, adjustable temperature that invokes appropriate operation of said valve actuators, and an electrical current sending device capable of driving said valve actuators based upon electrical signals transduced from said preset, adjustable temperature, whereby said evaporative cooler is either completely winterized or completely charged with water, such that without electrical power the first valve will be in the closed position to prevent water from entering said evaporative cooler and the second and third valves will be in the open position to allow water to drain from said evaporative cooler to provide freeze protection in the case of a electrical power outage during freezing conditions.

15. The water freeze prevention device of claim 14 wherein the temperature setting device employs a single temperature.

16. The water freeze prevention device of claim 14 wherein the temperature setting device employs two different temperatures.

17. The water freeze prevention device of claim 14 wherein the temperature setting device employs a single temperature and a tolerance from that single temperature of less than about three degrees Fahrenheit.

18. The water freeze prevention device of claim 14 wherein the temperature setting device employs two temperatures that are above 32° F. and are at least 5° F. from each other.

19. The water freeze prevention device of claim 14 wherein the ends of the first, second and third pipes are provided with pipe coupling devices.

20. The water freeze prevention device of claim 14 wherein the first, second and third valves can be operated in unison.

21. The water freeze prevention device of claim 14 wherein water freeze prevention device further comprises a mounting board to which some of the valves, the temperature setting device and the electrical current sending device are attached.

22. The water freeze prevention device of claim 14 wherein the electrical current sending device is a transformer that receives a 120 volt, 60 cycle current and converts it into a direct current suitable for operating the valves.

23. The water freeze prevention device of claim 14 wherein the valves are respectively operated by 15–20 volt, DC currents.

24. The water freeze prevention device of claim 14 wherein the electrical current sending device is a transformer that is connected to an electrical plug suitable for connection to a house current.

25. The water freeze prevention device of claim 14 wherein the temperature sensing device is a thermocouple.

26. The water freeze prevention device of claim 14 wherein the temperature setting device is a thermostat capable of storing at least one pre-selected temperatures.

27. The water freeze prevention device of claim 14 wherein the temperature setting device is a thermostat capable of storing two distinct pre-selected temperatures.

* * * * *